US010287755B1

(12) United States Patent
Hennings

(10) Patent No.: US 10,287,755 B1
(45) Date of Patent: May 14, 2019

(54) PORTABLE WASHOUT RUNOFF CATCHMENT

(71) Applicant: Marcus Lasalle Hennings, Columbus, OH (US)

(72) Inventor: Marcus Lasalle Hennings, Columbus, OH (US)

( * ) Notice: Subject to any disclaimer, the term of this patent is extended or adjusted under 35 U.S.C. 154(b) by 0 days.

(21) Appl. No.: 15/361,099

(22) Filed: Nov. 25, 2016

(51) Int. Cl.
*A47K 1/04* (2006.01)
*E03B 1/04* (2006.01)

(52) U.S. Cl.
CPC ..... *E03B 1/042* (2013.01)

(58) Field of Classification Search
CPC .. E04B 1/042; A47K 1/04; A47K 1/05; A47K 1/06; A47K 3/00; A47K 3/002; A47K 3/024; A47K 3/302; A47K 2003/305; A47K 2003/307; A61G 7/00; B65D 1/34; B65D 81/3813
USPC ..... 220/571
See application file for complete search history.

(56) References Cited

U.S. PATENT DOCUMENTS 4,413,363 A * 11/1983 Troiano ..... A47K 3/325 4/596
5,174,468 A * 12/1992 Holderman ..... B65F 1/004 220/495.08
6,041,959 A * 3/2000 Domanico ..... B65F 1/02 137/312
6,308,728 B1 * 10/2001 Frazier ..... G01M 3/04 137/15.11
7,047,577 B1 * 5/2006 Cirilli ..... A47K 3/325 4/599
9,663,924 B2 * 5/2017 Turner ..... E03L 31/042
2015/0014325 A1 * 1/2015 Stanek ..... B65D 90/24 220/571

FOREIGN PATENT DOCUMENTS

EP 314958 A1 * 5/1989

* cited by examiner

*Primary Examiner* — Joshua E Rodden

(57) ABSTRACT

A portable washout runoff catchment for commercial trailers. Catchment includes a liquid container base, a removable vertical barrier for reclaiming overspray and a liquid transfer pump.

1 Claim, 7 Drawing Sheets

PORTABLE WASHOUT RUNOFF CATCHMENT

CROSS REFERENCE

This application is a non-provisional application of and claims priority from U.S. provisional patent application Ser. No. 62/261,730 filed on Dec. 1, 2015. The foregoing application is incorporated herein by reference.

BACKGROUND

The U.S. Dept of Transportation (DOT) along with other federal and state agencies continuously form and revise policies in the trucking industry to increase public and environmental safety. In an effort to reduce driver fatigue which significantly contributes to accidents the DOT mandates and enforces commercial driver safety hours of service. Commercial drivers are given an allowance of 70 hours with designated mandatory breaks and off duty time. When service hours have been depleted the driver must have mandatory 10 and 34 hours of time off before a reset and issuance of additional duty time.

The DOT and product shippers regulate the cleaning of commercial trailer cargo areas. Special attention is given to temperature controlled units that transport food, pharmaceutical and other temperature sensitive items. Presently pressure washing is the method for cleaning this is known as washouts.

Washouts entail drivers proceeding to a truck wash facility to have this done. Unfortunately many washout facilities are overburdened and not conveniently located to shipping facilities which can be time consuming. This additional driving, idling and truck wear only adds to the existing greenhouse gases (GHG) and resource conservation problems. Other problems are that the driver must record and deduct all hours performing this duty from their maximum allowed duty hours. The loss of service hours reduce the driver productivity, income potential and increases fatigue. The driver is usually not compensated for washouts and companies have increased truck fuel consumption and wear cost.

SUMMARY

A portable washout runoff catchment reclaims, retains and transfers wastewater accumulated from mobile commercial trailer washouts. A portable washout runoff catchment comprises of a base container, a vertical barrier to divert overspray into the base container and a liquid transfer pump controlled by an automatic float switch and powered by a rechargeable battery. Mobile washout stations will aid in conserving commercial driver duty hours and resources such as truck fuel and wear while reducing GHG.

DETAILED DESCRIPTION

Figure 1:
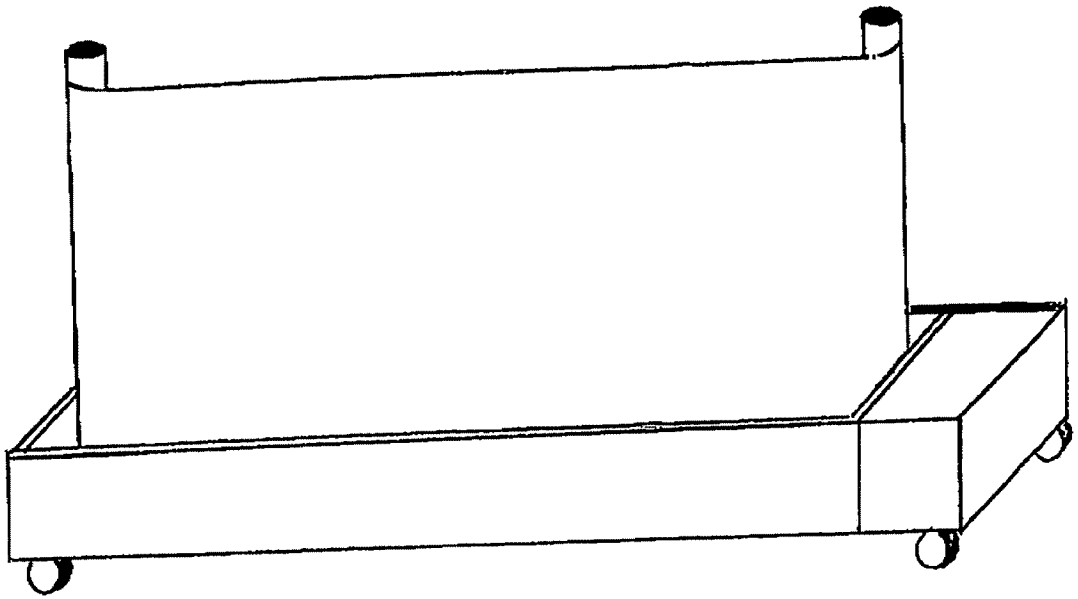
FIG. 1 illustrates an assembled portable washout runoff catchment.
Figure 2:
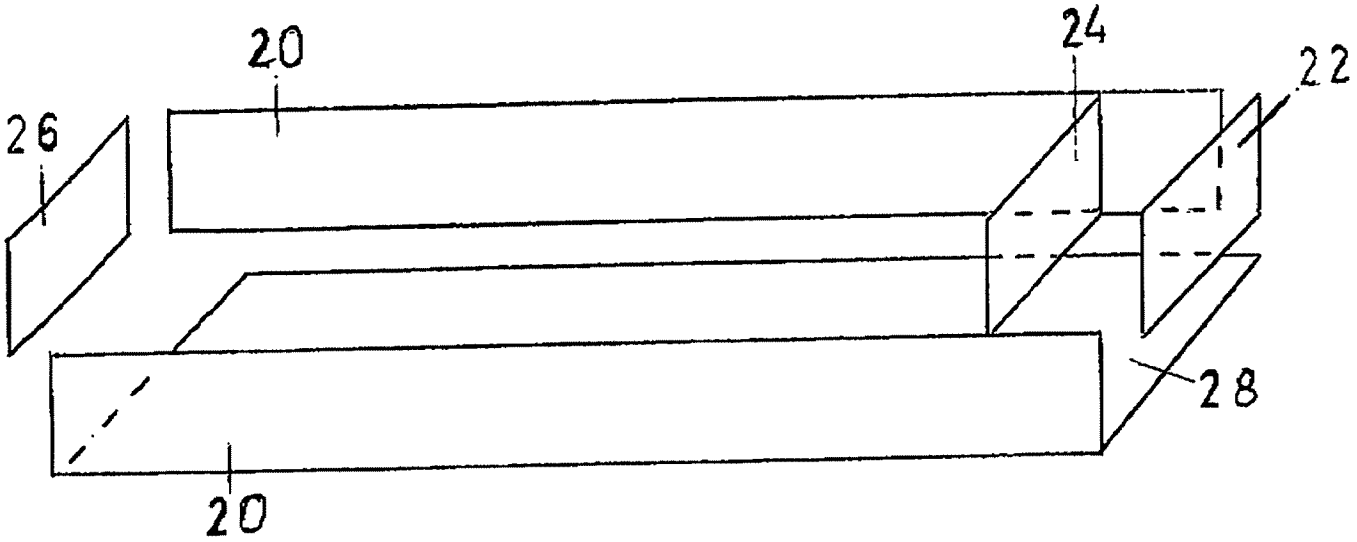
FIG. 2 illustrates an exploded view of the base container panels.
Figure 3:
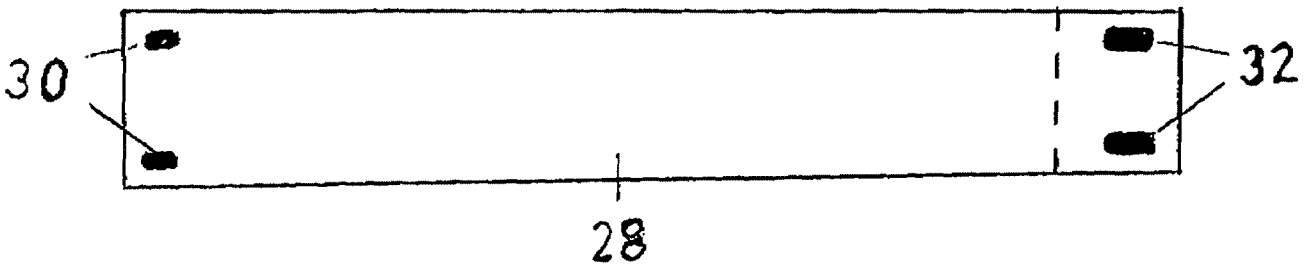
FIG. 3 illustrates the bottom panel caster wheel placement location.
Figure 4:
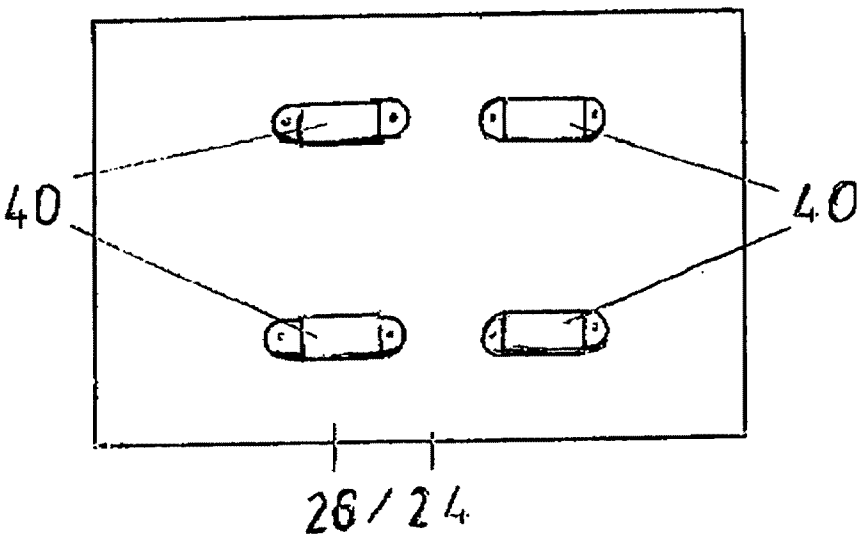
FIG. 4 illustrates the inner and end panel with metallic hole straps attached.
Figure 5:
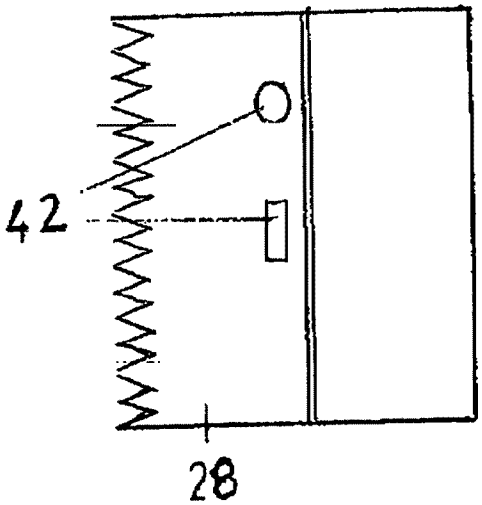
FIG. 5 illustrates a top view placement of the liquid transfer pump, automatic on/off switch and battery compartment.
Figure 6:
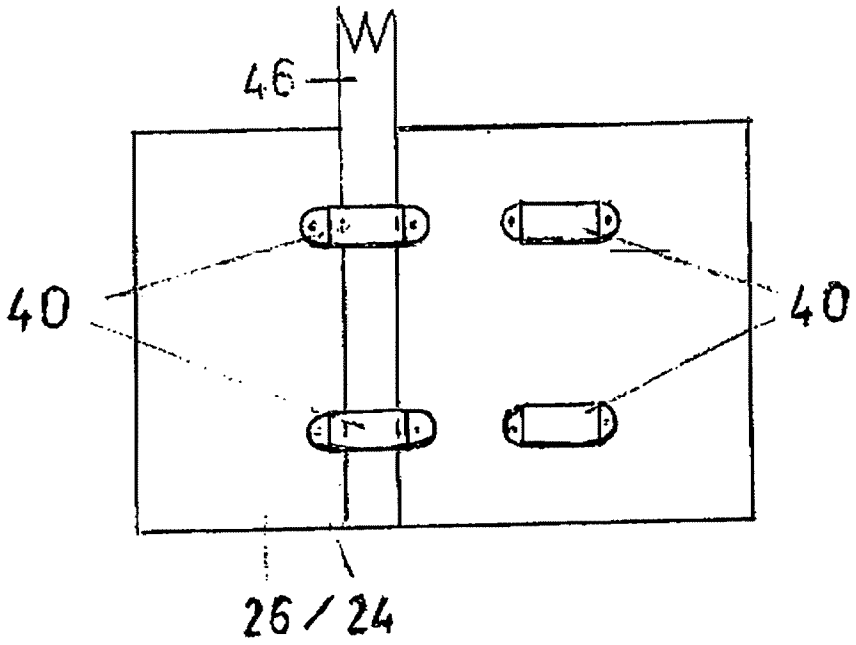
FIG. 6 illustrates the inner and end panels with the metallic whole strap with an inserted support pole.
Figure 7:
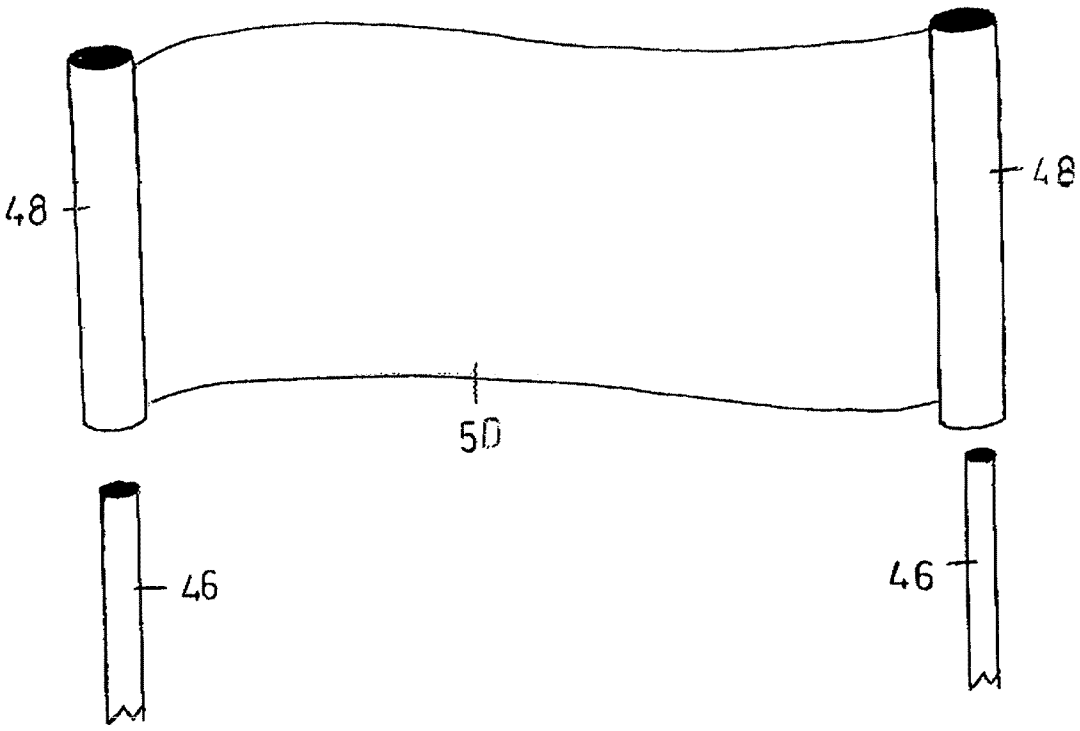
FIG. 7 illustrates 2 PVC poles with plastic sheeting before insertion onto 2 aluminum barrier support poles.

One embodiment of a portable washout runoff catchment is FIG. 1. Its base container is rectangular in shape. All container panels can be cut from sheets of aluminum with a gauge of 2.052 mm, however many liquid impervious materials may be used. This base comprises of 6 panels with all panels watertight welded. Two side panels 20 are 3.048 m in length and 508 mm in height. Three inner and end panels 22/24/26 are 812 mm in length and 508 mm in height. The bottom panel 28 is 1.048 m in length and 812.8 mm in width the panel arrangements are in accordance to FIG. 2.

Four swivel caster wheels 30/32 are permanently attached to the underside of the bottom panel. 2 wheels 30 are 76.2 mm and are attached approx 25.4 mm from the outer edges. 2 wheels are 50.8 mm and attached in the opposite corner of the panel approx 25.4 mm from the outer edges. Four metallic whole straps 40 are permanently attached to the inner and far end panels 24/26. They are arranged to mirror each other. A liquid transfer pump such as a bilge pump that is wired to an automatic on/off float switch is permanently attached to the bottom of the base container approx 2 mm from the inner panel. This vertical liquid overspray barrier comprises of four hollow poles 46/48 and approx 6 mil plastic sheeting. Two poles 48 are made of PVC and are 1.6 m in length with a 38 mm inner diameter. Two poles 46 are made of aluminum and are 2 m in length with a 25.4 mm outer diameter. The plastic sheeting is 1.6 m in width and 2 m in length.

Upon complete assembly and prior to a washout the portable washout runoff catchment is placed on the ground parallel to and partially under the rear trailer doors.

I claim:

1. A portable washout runoff catchment, the catchment comprising:

a base comprising six watertight panels which are welded together, the six panels including two side panels, two end panels, an inner panel, and a base panel, the two end panels and the inner panel being parallel to one another, with the inner panel being located between each of the end panels, and the inner panel being closer to one of the end panels than a remaining one of the end panels;

four metallic straps are attached to each of the inner panel and the remaining one of the end panels, the four metallic straps on the inner panel facing the four metallic straps on the remaining one of the end panels;

two aluminum poles designed to be received by two adjacent ones of the four metallic straps of either the inner panel or the remaining one of the end panels;

two PVC poles having plastic sheeting located between each of the PVC poles, each of the two PVC poles being hollow and designed to slide over a top of respective ones of the two aluminum poles;

four castors, each castor being located adjacent a respective one of four corners of the base panel;

the base having a liquid transfer pump that is wired to an automatic on/off float switch that is attached to the base panel between the inner panel and the remaining one of the end panels.

* * * * *